US006467235B2

(12) United States Patent
Kalkanoglu et al.

(10) Patent No.: US 6,467,235 B2
(45) Date of Patent: Oct. 22, 2002

(54) METHOD AND APPARATUS FOR MAKING A THICK-APPEARING SHINGLE

(75) Inventors: Husnu M. Kalkanoglu, Swarthmore; Kermit E. Stahl, North Wales; Joseph Quaranta, Yardley, all of PA (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 09/730,991

(22) Filed: Dec. 6, 2000

(65) Prior Publication Data

US 2001/0000372 A1 Apr. 26, 2001

Related U.S. Application Data

(62) Division of application No. 09/191,978, filed on Nov. 13, 1998, now Pat. No. 6,212,843.

(51) Int. Cl.[7] ..... E04D 1/12

(52) U.S. Cl. ..... 52/745.19; 52/311.2; 52/314; 52/540; 52/555; 52/559; 156/260; 156/299; 156/302; 428/143

(58) Field of Search ..... 52/540, 554, 555, 52/557, 311.2, 314, 745.19, 518; 156/259, 260, 299, 302; 428/143

(56) References Cited

U.S. PATENT DOCUMENTS 4,352,837 A 10/1982 Kopenhaver
4,717,614 A * 1/1988 Bondoc et al. ..... 428/143
5,181,361 A 1/1993 Hannah et al.
5,232,530 A * 8/1993 Malmquist et al. ..... 156/78
5,305,569 A * 4/1994 Malmquist et al. ..... 52/309.8
5,375,387 A * 12/1994 Davenport ..... 52/557
5,611,186 A * 3/1997 Weaver ..... 52/557
5,666,776 A * 9/1997 Weaver et al. ..... 52/557
5,901,517 A * 5/1999 Stahl et al. ..... 52/314
6,010,589 A * 1/2000 Stahl et al. ..... 156/260
6,014,847 A * 1/2000 Phillips ..... 52/311.1
6,038,826 A * 3/2000 Stahl et al. ..... 52/554
6,038,827 A * 3/2000 Sieling ..... 52/557
6,044,608 A * 4/2000 Stahl et al. ..... 52/518
6,105,329 A * 8/2000 Bondoc et al. ..... 52/557
6,195,951 B1 * 3/2001 Stahl et al. ..... 52/314
6,212,843 B1 * 4/2001 Kalkanoglu et al. ..... 52/555
6,289,648 B1 * 9/2001 Freshwater et al. ..... 52/557
6,305,138 B1 * 10/2001 Stahl et al. ..... 52/314

* cited by examiner

*Primary Examiner*—Yvonne M. Horton
(74) *Attorney, Agent, or Firm*—Paul & Paul

(57) ABSTRACT

A shingle and a method of and apparatus for making the shingle is provided, whereby patches of preselected granules or combinations of granules are provided, separated by transverse areas of different, preferably darker granules, having slots centrally thereof, to yield the appearance of multi-tab shingles that are thicker than they actually are, with transverse shadow lines. A longitudinal shadow line is optionally provided, along the upper and/or lower portion of the exposed tab.

24 Claims, 3 Drawing Sheets

METHOD AND APPARATUS FOR MAKING A THICK-APPEARING SHINGLE

This application is a divisional application of Ser. No. 09/191,978 filed Nov. 13, 1998, now U.S. Pat. No. 6,212, 843 dated Apr. 10, 2001.

BACKGROUND OF THE INVENTION

Manufacturers of asphalt shingles have, for many years, endeavored to produce shingles that resemble natural materials in appearance. Typical materials that manufacturers have sought to have asphalt shingles resemble are natural slate and cedar shakes. Techniques that manufacturers have employed have included applying an overlay to the shingle, or making a multiple-layered or laminated shingle.

In U.S. Pat. No. 4,352,837 to Kopenhaver, an overlay is taught, whereby, after a single layer of shingle is made, comprised of a mat, asphalt, and granules on an upper surface, the single layer thus made receives an overlay in the form of an additional partial coating of asphalt, which in turn, receives additional granules thereon, creating localized areas of additional thickness on the shingle, with such areas of additional thickness having the desired ornamentation.

In U.S. Pat. No. 5,181,361, to Hannah, et al, there is taught a laminated shingle, in which the shingle is comprised of a base layer and a secondary layer, and with a partial top layer, with each of the layers being comprised of an asphaltic web with granules applied to the top of the web, to yield a shingle with some portions being of two-layer thickness and other portions being of three-layer thickness.

Whether the shingle is of the overlay type or of the laminated type, various ornamental effects can be achieved by the use of variously colored granules.

Whether the thicker-appearing shingles are made by overlay techniques or by laminating layers together, there is, in each case, an additional expense associated with doing so, both in the use of additional materials, and in additional manufacturing steps.

SUMMARY OF INVENTION

The present invention is directed to creating the appearance of a thicker shingle, by employing a combination of slots and transverse or vertical visually distinct shading areas on each of the slots, relative to areas of different shading therebetween. The effect thereby makes the tabs appear to be thicker than they actually are. The visually distinct shading of the vertical areas where the slots exist is comprised of granules other than the granules that are used in the intermediate areas.

Accordingly, it is an object of this invention to provide a novel multi-tab shingle, having a thicker appearance for the tabs than the actual thickness of the shingle.

It is another object of this invention to accomplish the above object, wherein the shingle presents vertical or transverse shadow lines, substantially darker than adjacent areas of the tabs.

It is another object of this invention to provide a novel method of making such shingles.

It is a further object of this invention to provide novel apparatus for making said shingles.

It is another object of this invention to provide a novel method of and apparatus for synchronizing the cutting of slots between tabs such that the slots are located at the centers of the vertical or transverse shadow lines of the shingles.

It is a further object of this invention to provide a means for synchronizing the placement of the slots on a substantially continuous basis, by periodically sensing the placement of shadow lines on the shingle, and then correcting the location of cutting accordingly.

Other objects and advantages of the present invention will be readily apparent to those skilled in the art upon a reading of the following brief descriptions of the drawing figures, detailed descriptions of the preferred embodiment and the appended claims.

DETAILED DESCRIPTIONS OF THE PREFERRED EMBODIMENTS

Figure 1:
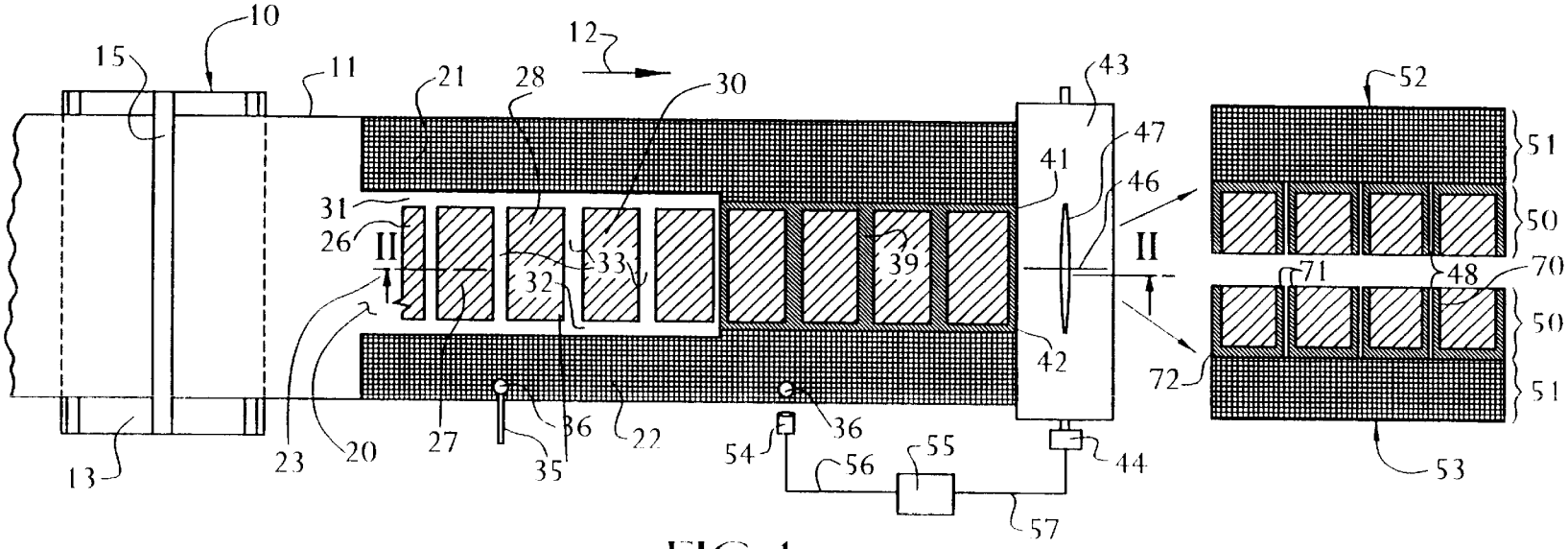
FIG. 1 is a schematic top plan view of a shingle manufacturing line in accordance with this invention, taken generally along the line I—I of FIG. 2, and wherein a pair of shingles a shown emanating from the shingle manufacturing line, at the right end of FIG. 1.

Referring now to the drawings in detail, reference is first made to FIG. 1, wherein, diagrammatically, there is shown at 10 equipment for providing a base web of reinforcing material impregnated and coated with a bituminous material. Such equipment 10 can comprise a dry looper, an asphalt saturation tank and/or an asphalt coating tank, and a finished product looper, for example of the types shown in U.S. Pat. No. 4,352,837 (the disclosure of which is herein incorporated by reference) or of any conventional type. From such equipment there will be provided a continuous bitumen impregnated mat 11, moving in the direction of arrow 12.

Figure 2:
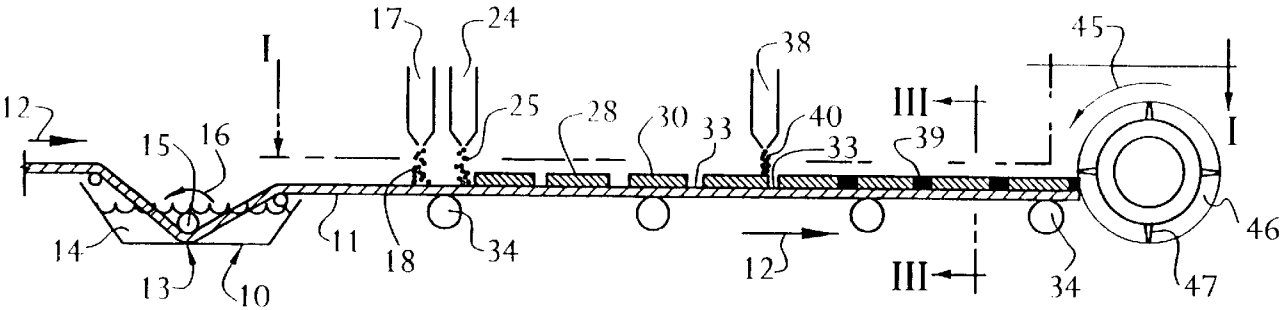
FIG. 2 is a longitudinal sectional view taken through the shingle manufacturing line of FIG. 1, generally along the line of 11—11 of FIG. 1.

With reference to the left end of FIG. 2, it will be seen that as the impregnated reinforcing material 11 is moved in the longitudinal direction 12, it passes beneath an adhesive coating station or applicator 13 of the equipment 10 (the rest of the equipment not being shown), in which adhesive 14, also preferably of the hot asphalt or bituminous type is applied to the impregnated reinforcing material 11, by means of an applicator roller 15 or the like rotating in the counter-clockwise direction shown by the arrow 16. Generally the applicator 13 will extend across the machine from one edge to the other, to completely coat the upper and the bottom (lower) surfaces of the impregnated reinforcing material. Depending on the type of reinforcement used, the impregnation and the coating process may occur in the same station 13.

Figure 5:
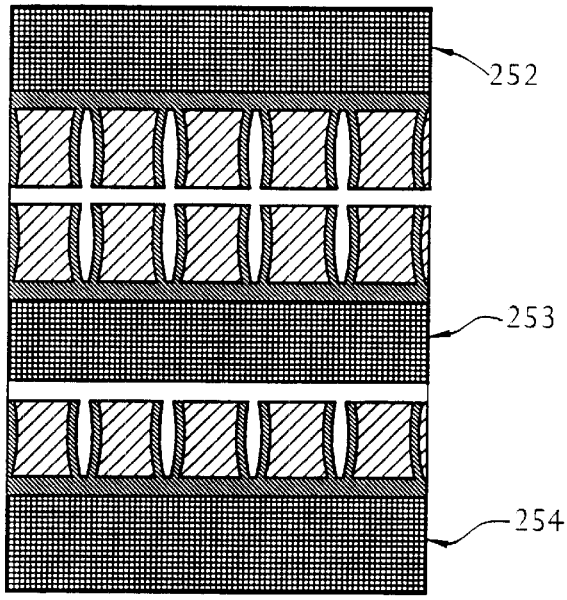
FIG. 5 is a view similar to that at the right end of FIG. 1, but wherein three parallel shingles are shown, having emanated from a shingle manufacturing line.

The impregnated and coated reinforcing material 11 then passes beneath the butt granule applicator 17 from which generally reclaimed or lower grade granules 18 (also called headlap granules and which may, if desired, be dark), are delivered to, adhere to the adhesive-coated upper surface 20 of the impregnated and coated reinforcing material in two continuous longitudinal strips 21 and 22, leaving a central uncovered area 23 therebetween. Depending on the width of the web or finished product (i.e. the shingles) the continuous longitudinal strips 21, 22 may be greater in number than two as shown in FIG. 1. For example, they could be three in number as shown in FIG. 5, wherein three distinct shingles 252, 253 and 254 simultaneously emanate from a shingle manufacturing line. It will be apparent that fewer shingles than two, for example one, or even three, four, or five or more shingles could simultaneously be produced, depending upon width of the sheet of material 11, and the width of the machine.

Figure 6:
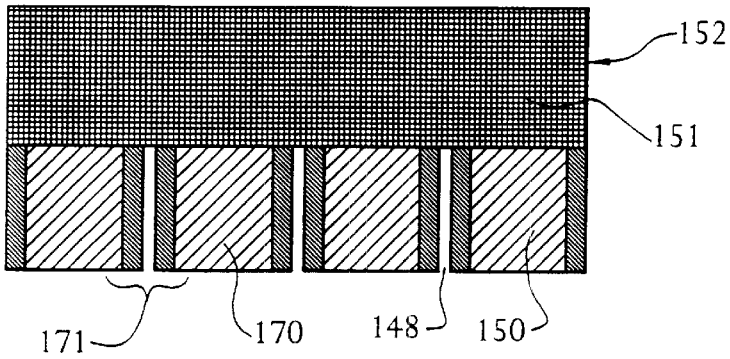
FIG. 6 is an alternatively ornamented shingle to those shown at the right end of FIG. 1.

The impregnated and coated reinforcing material 20 then passes beneath a decorative granule applicator 24, from which granules 25 emanate to yield decorative (often colored) patches 26, 27, 28, 30, etc., with these patches comprising areas that are separated from the longitudinal strips 21 and 22 by longitudinal areas 31 and 32 not yet having granules applied thereto. Alternatively, the longitudinal areas 31 and 32 could be omitted, to produce a shingle as shown in FIG. 6, in which the decorative patches 150, 170 are disposed adjacent the headlap area 151 of the shingle 152. It will also be apparent that the application of the headlap granules 18 need not necessarily occur prior to the application of the granules 25 that produce the decorative patches, in that the order of application of the granules 18, 25 and 40 could take any desired sequence, or could happen simultaneously.

In the representative application shown in FIG. 1, the patches 26, 27, 28, 30, etc. are also separated by transverse areas 33 that, likewise, do not yet have granules applied thereto, until passing beneath the granule applicator 38.

The impregnated and coated reinforcing material 11 is then conveyed farther downstream, in the direction of the arrow 12, via suitable conveyor rollers 34, or the like.

A marking means 35 applies a suitable mark 36 onto the shingle material, preferably in the butt or headlap area, with the mark 36 corresponding to the placement of a transverse area 33, either directly related to the center of the transverse area 33, or related to it in some indirect manner, as for example by being located to correspond to some other locator, such as either a leading edge or a trailing edge of one or more of the patch areas 26, 27, 28, 30, etc. The marking means 35 may be of any desired type, such as will produce a visual mark, non-visual mark, magnetic mark, notch or the like, that may later be read to correlate the transverse cutting of slots, as will hereinafter be described.

The continuous sheet of shingle material then continues to move in a downstream direction, to pass beneath granule applicator 38, from which granules 40 are dispensed onto transverse areas 39 and onto longitudinal areas 31, 32. In the event that longitudinal areas 31, 32 are not to have granules 40 applied from the hopper 38, thereto, then the granules 40 applied from the hopper 30 are only dispensed onto transverse areas 39. Preferably, the granules 40 will be darker or lighter or different than the granules that comprise the zones 26, 27, 28, 30, etc. to yield longitudinal shadow lines 41 and 42 and transverse shadow lines 39. The continuous strip of shingle material 11 then is delivered to a cutting roller 43 driven by a suitable motor/clutch apparatus 44, in the counter-clockwise direction shown by the arrow 45.

The cutter 43 preferably comprises a generally cylindrical roller having a longitudinal cutting blade 46 in the form of a roller knife thereon for severing the continuous sheet of shingle material 11 in half, in a longitudinal direction, and a plurality of transverse knives 47 extending from the surface thereof, preferably equidistantly spaced about the periphery thereof, as shown in FIG. 2, for cutting transverse slots 48 in the shingle tab portions 50 as shown in FIG. 1. While most of the transverse knives 47 are of a transverse length sufficient to cut slots 48 as shown in FIG. 1, generally one of the transverse knives 47 will be of a length (not shown) sufficient to cut completely across the sheet of shingle material 11, in the transverse direction, to separate individual shingles from each other in the longitudinal direction, to yield a pair of discrete shingle 52, 53, as shown at the right end of FIG. 1.

It will be apparent that in cutting the slots 48, such slots may take on various forms, in that they need not necessarily be at right angles to the direction of material flow as shown by the arrow 12 in FIG. 2, but may be angled as shown, for example in FIG. 5, as may be desired. Also, it will be apparent that not all slots in a given shingle need be identically configured, but that the blades, such as the blade 47 may be of any desired configuration, and not all the blades 47 need be identically configured. Thus, a wide variety of variations are possible in accordance with the present invention.

A sensor 54 is provided, for sensing the mark 36 and delivering a signal to a computer or other controller 55 via a signal line 56, which, in turn can signal, via line 57 to motor/clutch 44, to speed up or slow down the rotation of the cutting roller 43, so that the longitudinal locations of the slots 48 can be controlled to be precisely at the centers of the transverse areas 39 in that the placement of the marks 36 was initially effected based upon the locations of the transverse areas 33, to which the granules 40 were applied. It will be apparent that, if the mark 36 is a metal of the type capable of detection by means of a magnet, then the sensor 54 could be a magnet or some other detector capable of sensing the presence of a metal mark. If the mark 36 is a notch, or other visually discernable mark, then the sensor would generally be a visual detection means.

Figure 3:
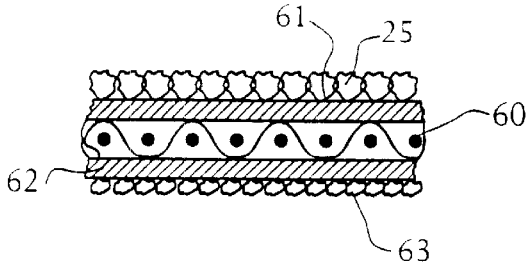
FIG. 3 is an enlarge fragmentary transverse sectional view, taken through shingle material as it is being manufactured, prior to being cut, and taken generally along the line III—III of FIG. 2.

With reference to FIG. 3, it will be seen that the sheets of continuous shingle material 11, and eventually the shingles 52, 53, are comprised of a web 60 of reinforcing material impregnated with asphalt or other bituminous material. A layer 61 of coating 14 is applied to the upper surface thereof shown in FIG. 3 by means of the coating applicator 13, and granules such as those of 18, 25 or 40 are secured to the web 60 by the coating 61. On the undersurface as shown in FIG. 3, another layer of coating 62 is applied thereto, and other particles 63, such as sand, limestone or other small particles are generally applied to the undersurface of the shingle.

It will be noted that the shingles 52 and 53 thus each have butt portions 51 and tab portions 50. In each tab portion 50 there are a plurality of spaced-apart first areas 70 having granules 25 applied thereto. The granules 25 will be of a selected color, mix of colors, or could even be of different colors or mixes of colors on the same shingle, such that a given shingle could have a plurality of areas 70 run longitudinally of the shingle, with different visual appearances, or the same visual appearance, as may be desired. These areas 70 will have a preselected shading. However, the transverse areas 39 where the granules 40 are adhered will be comprised of granules that are different than the granules 25, so that the areas 71 will be visually distinct from the areas 70 that they separate. Similarly, the longitudinal areas 72, if they are chosen to exist, running the length of the shingle in the longitudinal direction, in that end of the tab portion that is next to the butt portion, will preferably also be comprised of different granules like the granules in transverse areas 71, to yield both longitudinal and transverse shadow line areas. The slots 48 are each narrower than the width of the areas 71 in the longitudinal direction, and each slot is located longitudinally so as to be centered longitudinally in its area 71, so that the same width of different colored transverse shadow line will exist on each of the slot 48. The granules making up longitudinal areas 71 may or may not be identical to one another in color. The shingles 52, 53, will thus simulate shingles of greater thickness than the shingles actually have, by means of the transverse shadow lines 71.

Figure 4:
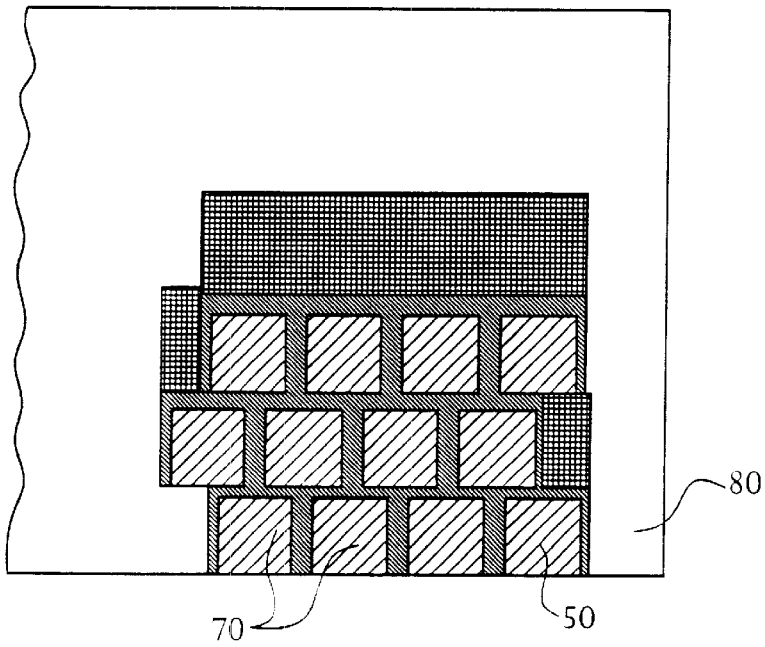
FIG. 4 is an array of shingles in accordance with this invention, being laid-up on a roof, with of being fragmentally illustrated.

With reference to FIG. 4, it will be seen that there is presented an array of shingles 51 in laid-up condition on a roof 80, staggered leftwardly and rightwardly in each successive course, as the shingles are applied to the roof 80, such that the darkened bun portion is generally covered, except for the granules on the butt portions that are exposed through slots 48, such that, in the laid-up condition of shingles on a roof, there is the appearance of generally continuous darkened transverse areas between adjacent areas 70.

With reference to FIG. 6, it will be seen that the decorative areas 150, 170 are separated by slots 148, producing a different visual effect for the shingle of FIG. 6, from that shown for the shingles appearing at the right end of FIG. 1. In this regard, the transverse shadow lines 171 are present, but there are no longitudinal shadow lines, with the decorative areas 150, 170 extending up to headlap portion 151 of the shingle 152.

Figure 7:
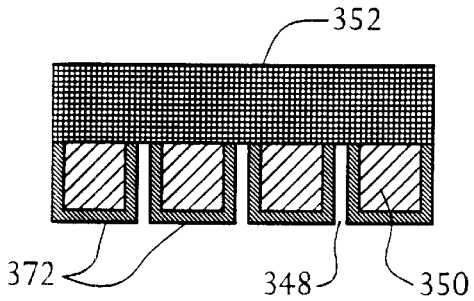
FIG. 7 is a further alternatively ornamented shingle to those shown at the right end of FIG. 1 and to that shown in FIG. 5.

With reference to FIG. 7, another alternative shingle 352 is shown, similar to that 152 of FIG. 6, but wherein longitudinal shadow lines 372 are shown at the lower ends of the tabs 350 of the shingles spaced apart at 348, for another visual effect.

Figure 8:
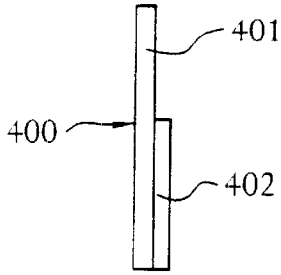
FIG. 8 is an end view of a laminated shingle in accordance with this invention.

With reference to FIG. 8, it will be seen that the shingles of this invention, as shown at the right end of FIG. 1, and in each of FIGS. 5–7, could be comprised as a laminated shingle 400, having an anterior layer 401 and a posterior layer 402, secured together with an adhesive substance such as asphalt therebetween. While the layer 402 of shingle 400 is shown in end view as being disposed against the rear surface of the tab portion only of the shingle 400, it will be understood that the same could extend upwardly behind the headlap portion of the shingle 400, if desired.

It will be apparent that in the various shingles illustrated in accordance with this invention, the headlap of each of the shingles is shown using the drafting expedient of a rectangular grid, with the ornamental areas 70, 150, 170, 350, being shown having a diagonal grid, to distinguish the same visually from the headlap areas, and with the transverse and longitudinal shadow areas 72, 39, 171 and 372 being shown darker, also as a drafting expedient. It will be understood that such rectangular grids, diagonal grids, and darkened areas are merely intended to indicate areas of different colors, shading, or ornamentation.

It will be apparent from the foregoing that various modifications may be made in the details of construction of the shingle, as well as in the method and apparatus of making the shingle, as well as the use thereof, all within the spirit and scope of the claims.

What is claimed is:

1. A method of making a shingle having a butt portion and a tab portion, comprising the steps of (a) providing a base web of reinforcing material impregnated with and coated with an adhesive material as a hardenable coating to an upper and lower surface thereof, (b) conveying the impregnated reinforcing material in a longitudinal direction;

(c) applying granules in longitudinal strips onto portions of the hardenable coating on the upper surface as the impregnated and coated reinforcing material is moved longitudinally, to define the butt portion of a continuous strip of shingle material where the granules are applied and the tab portion where the granules are not applied;

(d) applying granules of a first shading, onto the hardenable coating on the upper surface in spaced-apart transverse first areas in the tab portion of the continuous strip of shingle material, to cover said transverse first areas;

(e) cutting the continuous strip of shingle material into a plurality of shingles; and (f) transversely cutting slots of size in said transverse first areas, so that each said slot is narrower in the longitudinal direction than the transverse area in which it is located, leaving granules of said first areas spaced apart on each side of said slot.

2. The method of claim 1, including the step of applying granules of a second shading in longitudinally spaced-apart areas in the tab portion of the continuous strip of shingle material, onto portions of the hardenable coating on the upper surface, to define areas of a second shading of a tab portion of the strip of shingle material, leaving longitudinally spaced-apart transverse first areas on the upper surface of the tab portion of the shingle material between adjacent ones of said second areas.

3. The method of claim 2, wherein the step of applying granules of said second shading includes applying granules of a shading that is visually distinct from the granules applied in the first areas.

4. The method of claim 2, wherein the step of applying granules of a second shading comprises applying granules of a lighter shading than in the step of applying granules of a first shading.

5. The method of claim 2, wherein the step of applying granules of a second shading comprises applying granules of a darker shading than in the step of applying granules of a first shading.

6. The method of claim 1, wherein the cutting step (e) includes longitudinally separating the continuous strip of shingle material into a plurality of longitudinal strips.

7. The method of claim 1, wherein the cutting steps occur substantially simultaneously.

8. The method of claim 1, including the step of sensing a sensible mark on the continuous strip of shingle material and synchronizing the longitudinal location of cutting of the transverse slots to essentially the centers of the transverse slots.

9. The method of claim 8, wherein said synchronizing step includes adjusting the speed of cutting the transverse slots.

10. The method of claim 8, wherein the sensing step includes optically sensing a visually discernible mark on the continuous strip of shingle material.

11. The method of claim 8, wherein the sensing step includes magnetically sensing a metallic mark on the continuous strip of shingle material.

12. The method of claim 2, wherein the steps of applying granules of first and second shadings comprise applying only a single layer of granules to said first and second areas.

13. Apparatus for making a shingle having a butt portion and a tab portion, comprising:

(a) means for providing a base web of reinforcing material impregnated with and coated with an adhesive material as a hardenable coating to an upper and lower surface;

(b) means for conveying the impregnated reinforcing material in a longitudinal direction;

(c) means for applying granules in longitudinal strips onto portions of the hardenable coating on the upper surface as the impregnated and coated reinforcing material is moved longitudinally, to define the butt portion of a continuous strip of shingle material where the granules are applied and the tab portion where the granules are not applied;

(d) means for applying granules of a first shading, onto the hardenable coating on the upper surface in spaced-apart transverse first areas in the tab portion of the continuous strip of shingle material, to cover said transverse first areas;

(e) means for cutting the continuous strip of shingle material into a plurality of shingles; and (f) means for transversely cutting slots of size in said transverse first areas, so that each said slot is narrower in the longitudinal direction than the transverse area in which it is located, leaving granules of said first areas spaced apart on each side of said slot.

14. The apparatus of claim 13, including means for applying granules of a second shading in longitudinally spaced-apart areas in the tab portion of the continuous strip of shingle material, onto portions of the hardenable coating on the upper surface, to define areas of a second shading of a tab portion of the strip of shingle material, leaving longitudinally spaced-apart transverse first areas on the upper surface of the tab portion of the shingle material between adjacent ones of said second areas.

15. The apparatus of claim 14, wherein means for applying granules of said second shading includes means for applying granules of a shading that is visually distinct from the granules applied in the first areas.

16. The apparatus of claim 14, herein means for applying granules of a second shading comprises means for applying granules of a lighter shading than in the step of applying granules of a first shading.

17. The apparatus of claim 14, wherein means for applying granules of a second shading comprises means for applying granules of a darker shading than the means for applying granules of a first shading.

18. The apparatus of claim 13, wherein the means for cutting includes means for longitudinally separating the continuous strip of shingle material into a plurality of longitudinal strips.

19. The apparatus of claim 13, wherein the means for cutting is a means for doing so substantially simultaneously.

20. The apparatus of claim 13, including means for sensing a sensible mark on the continuous strip of shingle material and means for synchronizing the longitudinal location of cutting of the transverse slots to essentially the centers of the transverse slots.

21. The apparatus of claim 20, wherein said means for synchronizing includes means for adjusting the speed of cutting the transverse slots.

22. The apparatus of claim 20, wherein the means for sensing includes means for optically sensing a visually discernable mark on the continuous strip of shingle material.

23. The apparatus of claim 20, wherein the sensing includes means for magnetically sensing a metallic mark on the continuous strip of shingle material.

24. The apparatus of claim 14, wherein the means for applying granules of first and second shadings comprise means for applying only a single layer of granules to said first and second areas.

* * * * *

UNITED STATES PATENT AND TRADEMARK OFFICE

CERTIFICATE OF CORRECTION

PATENT NO. : 6,467,235 B2 
DATED : October 22, 2002
INVENTOR(S) : Husnu M. Kalkanoglu, Kermit E. Stahl and Joseph Quaranta It is certified that error appears in the above-identified patent and that said Letters Patent is hereby corrected as shown below:

Column 2,
Line 26, after the word "with" delete the word "of" and replace with -- the roof --

Column 3,
Line 5, after the word "to" and before the word "adhere" remove the comma Signed and Sealed this Eighteenth Day of February, 2003

JAMES E. ROGAN
*Director of the United States Patent and Trademark Office*